US008371965B2

(12) United States Patent
Quinn

(10) Patent No.: US 8,371,965 B2
(45) Date of Patent: Feb. 12, 2013

(54) MINIATURE DOOR-MOUNTED BASKETBALL HOOP

(75) Inventor: Thomas A. M. Quinn, Carlsbad, CA (US)

(73) Assignee: Pro Performance Sports, Carlsbad, CA (US)

( * ) Notice: Subject to any disclaimer, the term of this patent is extended or adjusted under 35 U.S.C. 154(b) by 249 days.

(21) Appl. No.: 12/786,646

(22) Filed: May 25, 2010

(65) Prior Publication Data

US 2010/0304903 A1 Dec. 2, 2010

Related U.S. Application Data

(60) Provisional application No. 61/181,092, filed on May 26, 2009.

(51) Int. Cl.
*A63B 63/08* (2006.01)

(52) U.S. Cl. ..... 473/487; 473/486; D21/703

(58) Field of Classification Search ..... 473/487, 473/433, 486, 481; 273/402; D21/699–705
See application file for complete search history.

(56) References Cited

U.S. PATENT DOCUMENTS

| | | | | | |
|---|---|---|---|---|---|
| 1,052,670 | A | * | 2/1913 | Francis | 52/509 |
| 2,077,617 | A | * | 4/1937 | Cramer | 264/255 |
| RE20,898 | E | * | 10/1938 | Schabinger | 473/487 |
| 2,517,463 | A | * | 8/1950 | Cobb | 473/481 |
| 3,194,555 | A | | 7/1965 | Humphrey | |
| 4,183,522 | A | * | 1/1980 | Killen | 473/483 |
| 4,468,027 | A | * | 8/1984 | Pangburn | 473/481 |
| 4,483,534 | A | | 11/1984 | O'Donnell | |
| 4,588,188 | A | * | 5/1986 | Mahoney et al. | 473/481 |
| 4,715,600 | A | | 12/1987 | Offutt | |
| 4,834,369 | A | * | 5/1989 | Walsh | 473/481 |
| 4,895,365 | A | * | 1/1990 | Schroeder | 473/481 |
| 4,926,060 | A | | 5/1990 | Sittig | |
| 4,955,605 | A | * | 9/1990 | Goldfarb | 273/375 |
| 5,007,637 | A | * | 4/1991 | Foley | 473/487 |
| 5,037,092 | A | | 8/1991 | Blackburn | |
| 5,071,120 | A | * | 12/1991 | Dadbeh | 473/486 |
| 5,098,108 | A | | 3/1992 | McKinney | |
| D327,928 | S | | 7/1992 | Cochran | |
| D337,199 | S | | 7/1993 | Ochs | |
| 5,318,289 | A | * | 6/1994 | Mahoney et al. | 473/486 |
| 5,480,139 | A | * | 1/1996 | Owen et al. | 473/486 |

(Continued)

FOREIGN PATENT DOCUMENTS

| | | |
|---|---|---|
| JP | 2002-331057 | 11/2002 |
| KR | 20-1988-000424 | 2/1988 |

(Continued)

OTHER PUBLICATIONS

Korean Intellectual Property Office, International Search Report for PCT/US2010/036023, mailed Dec. 14, 2010.

(Continued)

*Primary Examiner* — Gene Kim
*Assistant Examiner* — M Chambers
(74) *Attorney, Agent, or Firm* — Kenneth H. Ohriner; Perkins Coie LLP

(57) ABSTRACT

A miniature basketball hoop has a pair of spaced apart hooks on the top of a backboard to hook the backboard over the top of a door. The hoop includes a break-away rim mounted to the front of the backboard, and sound dampening material on the rear face of the backboard, so as to minimize sound when a ball hits the backboard or rim during use.

6 Claims, 9 Drawing Sheets

U.S. PATENT DOCUMENTS

| | | | | |
|---|---|---|---|---|
| 5,902,198 | A | 5/1999 | Martin et al. | |
| D431,620 | S | 10/2000 | Hill | |
| 6,447,409 | B1 * | 9/2002 | Squibb | 473/486 |
| 7,052,418 | B2 | 5/2006 | Nye et al. | |
| D608,848 | S | 1/2010 | Quinn | |
| 7,753,375 | B1 | 7/2010 | Neal et al. | |
| 7,794,342 | B2 | 9/2010 | Connerley et al. | |
| 7,798,921 | B2 * | 9/2010 | Connerley | 473/485 |
| 7,955,082 | B1 | 6/2011 | Gause | |
| D647,983 | S | 11/2011 | Quinn | |
| 2004/0038760 | A1 * | 2/2004 | Diaz et al. | 473/485 |
| 2004/0224797 | A1 * | 11/2004 | Huang | 473/480 |
| 2007/0048445 | A1 * | 3/2007 | DiMario | 427/180 |
| 2007/0054759 | A1 | 3/2007 | Nye et al. | |
| 2009/0264226 | A1 * | 10/2009 | Mauro | 473/488 |
| 2010/0267495 | A1 | 10/2010 | Heystek | |

FOREIGN PATENT DOCUMENTS

| | | |
|---|---|---|
| KR | 10-1994-0020267 | 9/1994 |
| KR | 10200900105666 A | 1/2009 |

OTHER PUBLICATIONS

Korean Intellectual Property Office, International Preliminary Report on Patentability for PCT/US2010/036023, Sep. 20, 2011.

* cited by examiner

MINIATURE DOOR-MOUNTED BASKETBALL HOOP

CROSS-REFERENCE TO RELATED APPLICATIONS

This application claims priority under 35 U.S.C. §119 of a provisional application Ser. No. 61/181,092 filed May 26, 2009, and which application is hereby incorporated by reference in its entirety.

BACKGROUND OF THE INVENTION

Various forms of miniature basketball hoops are well known for mounting on bedroom, dorm room, and office doors. Such prior art miniature hoops normally include a backboard with a rounded top edge and one or two hooks on the backboard for mounting over the top edge of the door. The construction of these prior art mini hoops is generally lightweight, such that the hoops do not withstand slam dunks or other abuse. For example, such miniature hoops typically are rigid, such that a slam dunk either breaks the rim or breaks the hooks which mount the hoop to the door.

Therefore, a primary objective of the present invention is the provision of an improved miniature basketball hoop for mounting on a door.

DESCRIPTION OF THE INVENTION

Figure 9:
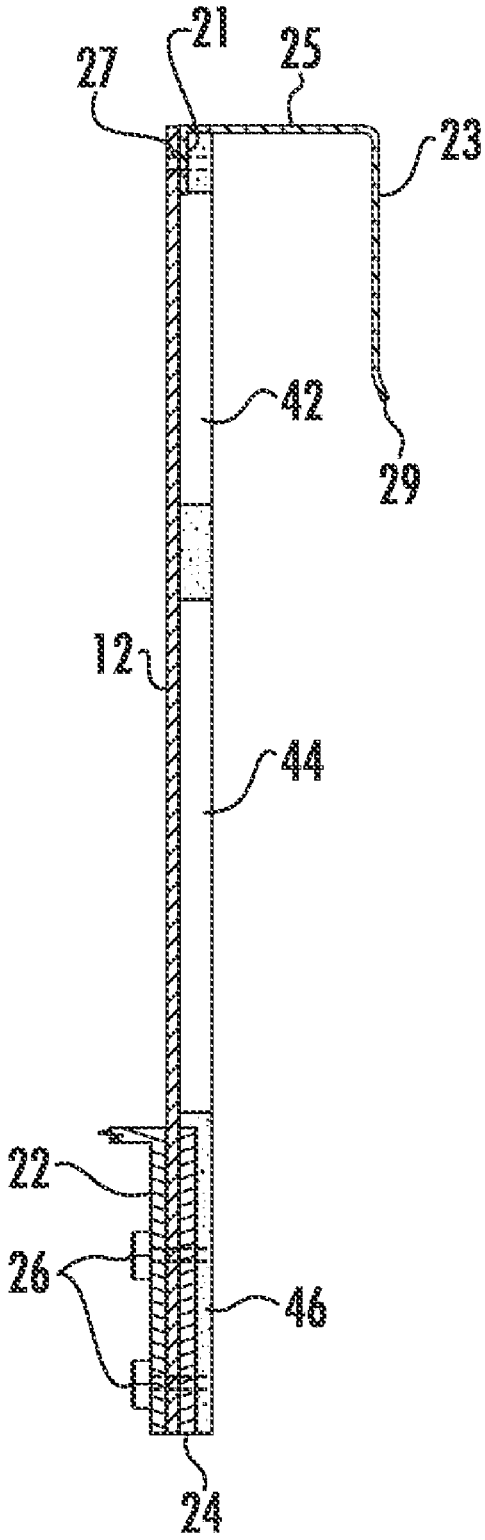
FIG. 9 is a sectional view taken along lines 9-9 of FIG. 3.

A basketball hoop 10 generally includes a polycarbonate, shatterproof backboard 12 to which a break-away rim 14 is mounted. The backboard 12 is rectangular and includes front and rear faces. The backboard 12 is transparent substantially across its full dimension, except for an outer perimeter strip or band 16 adjacent the four perimeter edges of the backboard 12, and the bank target 18 above the rim 14. A pair of hooks 20 are mounted on the rear face of the backboard 12 and extend rearwardly and downwardly from the upper edge of the backboard 12. Thus, the hooks 20 are substantially hidden by the door when the hoop 10 is mounted on the door. Preferably, the hooks 20 are a squared C-shape, with a front leg 21, a top leg 25 and a rear leg 23. As shown in FIG. 9, the front leg 21 is secured to the backboard 12 by one or more bolts 27. The lower end 29 of the rear leg 23 may be flared to facilitate mounting of the hoop 10 on the door.

The rim assembly 14 includes a pair of mounting plates 22, 24 positioned on opposite sides of the backboard 12 and secured thereto by a plurality of bolts 26. A horizontal plate 28 is pinned to the front mounting plate 22 via a hinge 30. A metal rim 32 is welded to the front edge of the upper horizontal plate 28. The hinge 30 includes first and second pairs of hinge tubes or collars 31, 33 welded to the plates 22, 28 respectively, with a hinge pin 35 extending through the aligned collars, so that the horizontal plate 28, to which the rim 32 is welded, can pivot relative to the plate 22. A lower horizontal plate 34 is welded to the front mounting plate 22. A spring 36 extends between the upper and lower horizontal plates 28, 34 such that the rim 32 is spring biased, so as to be a break-away rim which pivots resiliently downwardly when a ball is dunked through the rim 32. The spring 36 normally biases the rim 32 back to a horizontal position after a dunk is completed.

The rim 32 includes a plurality of hooks 38 to which a basketball net 40 is removably mounted.

Figure 1:
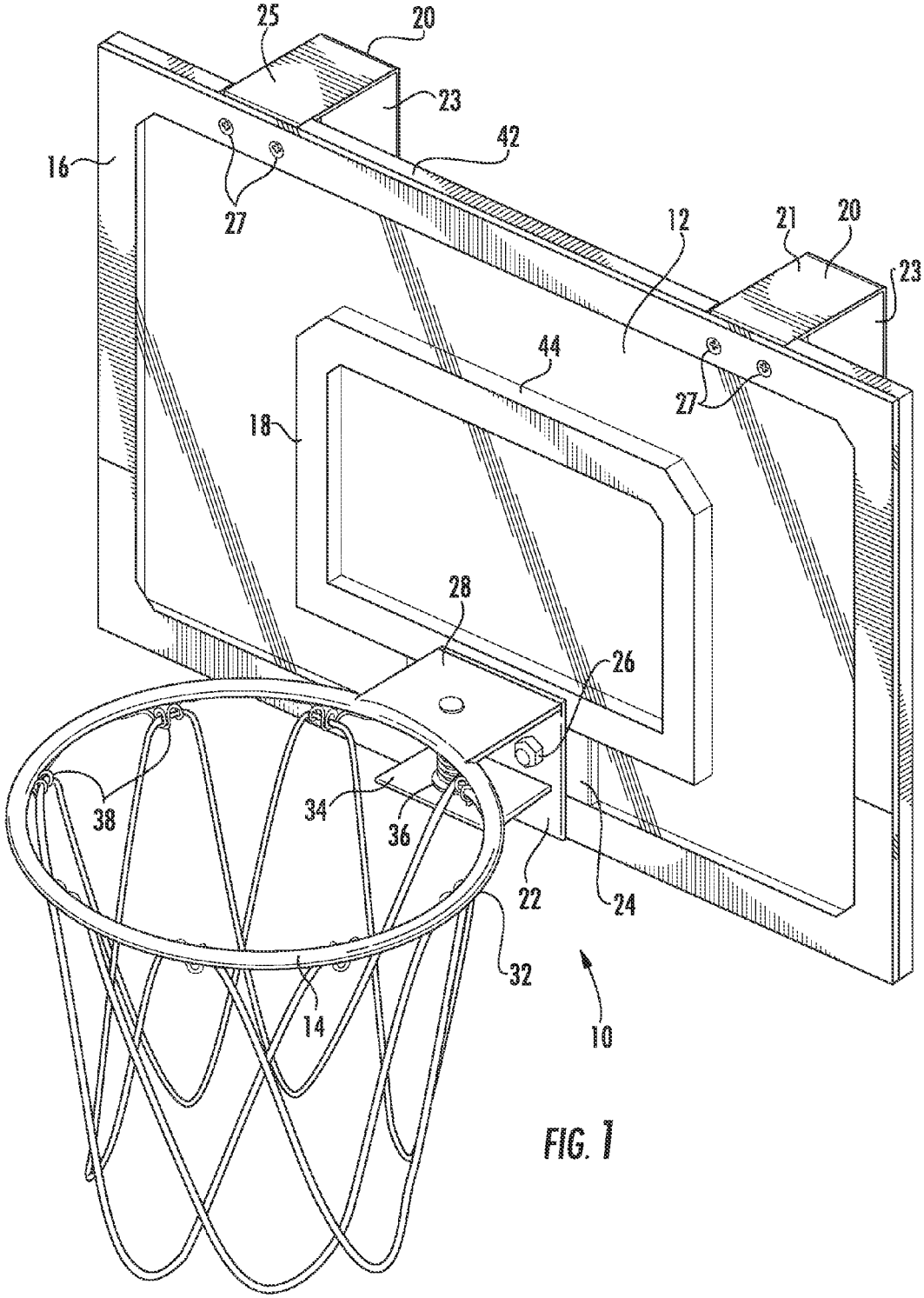
FIG. 1 is a perspective view of the miniature basketball backboard and hoop according to the present invention.
Figure 2:
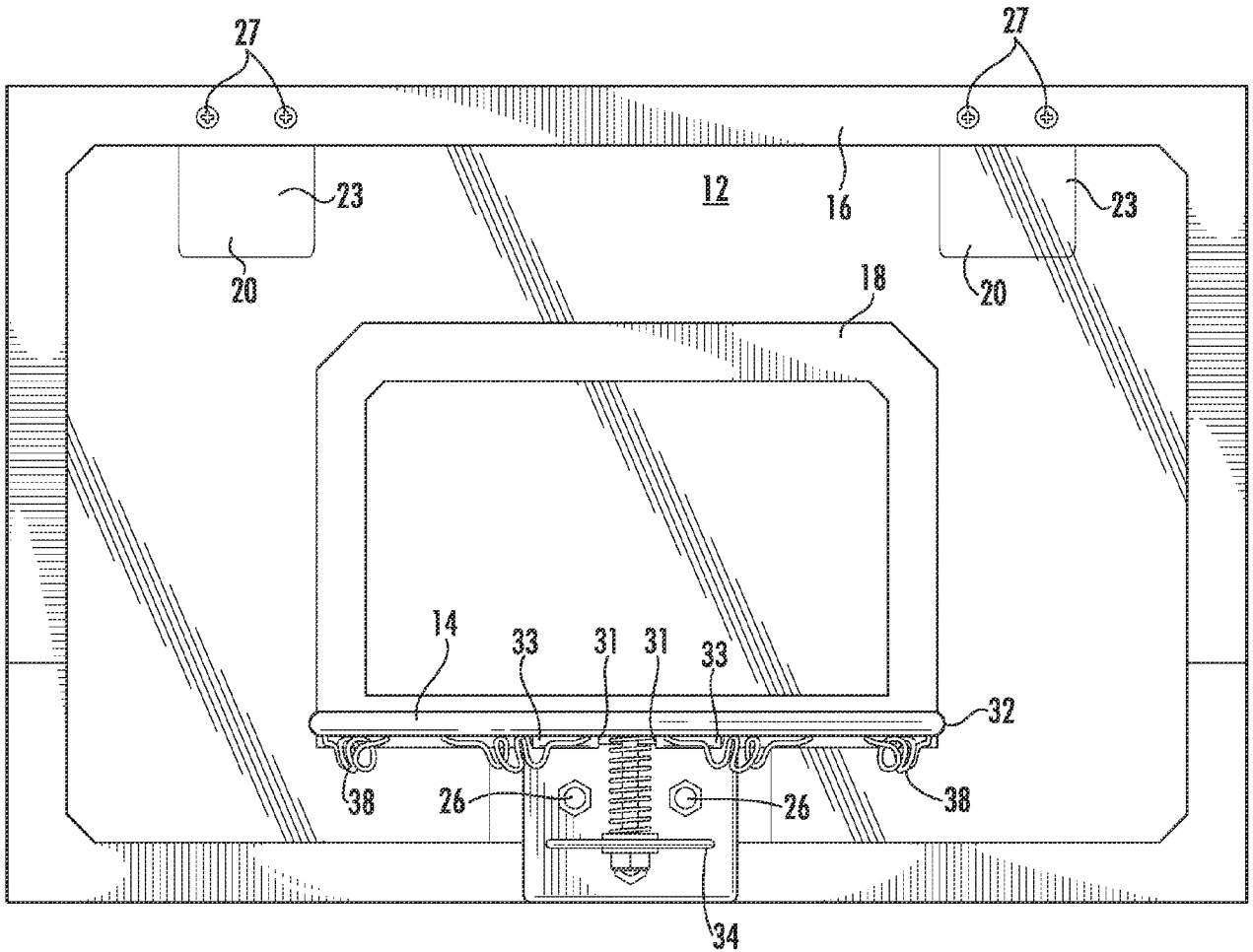
FIG. 2 is a front elevation view of the backboard and hoop, with the net removed for clarity.
Figure 3:
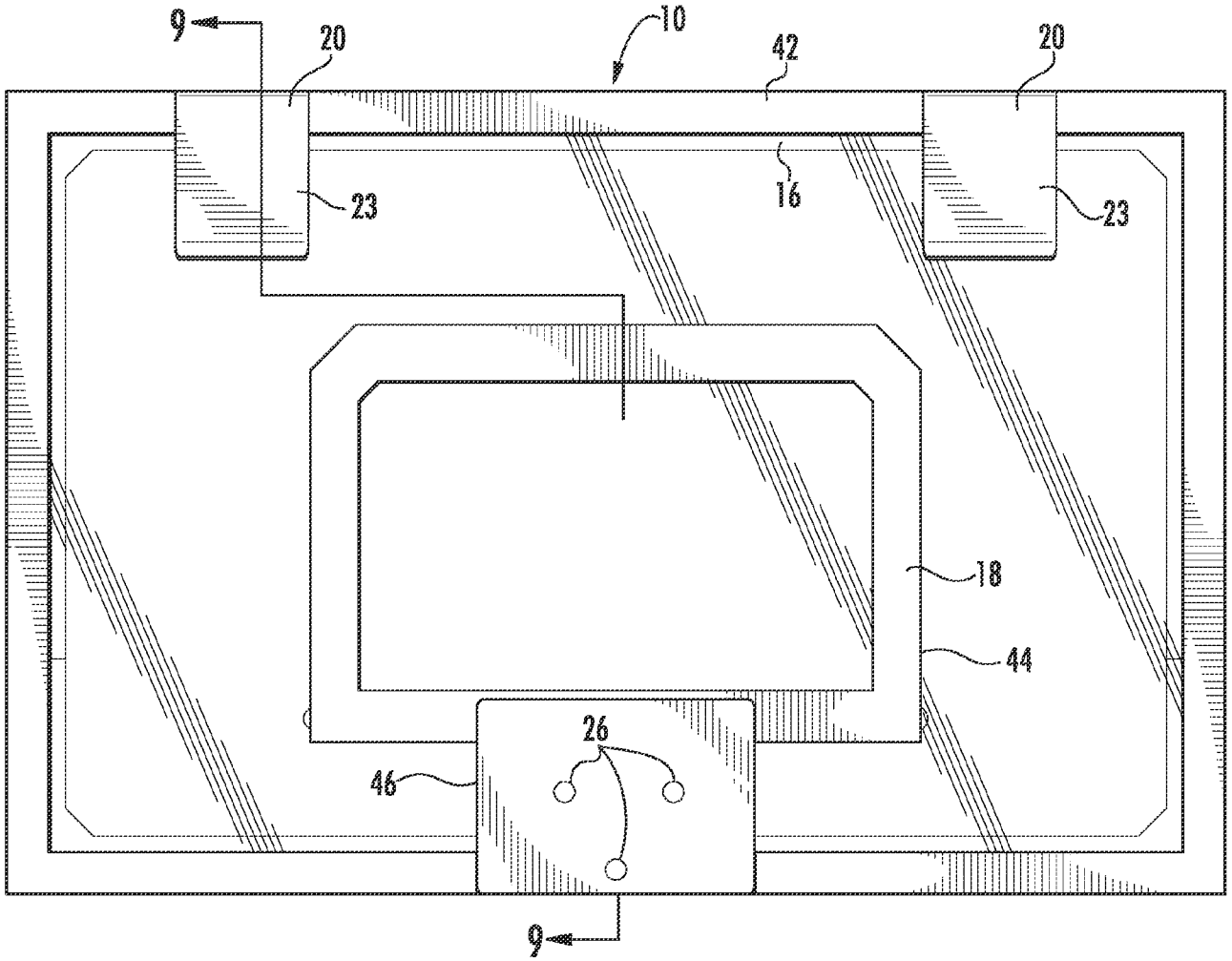
FIG. 3 is a rear elevation view of the backboard and hoop, with the net removed for clarity.
Figure 4:
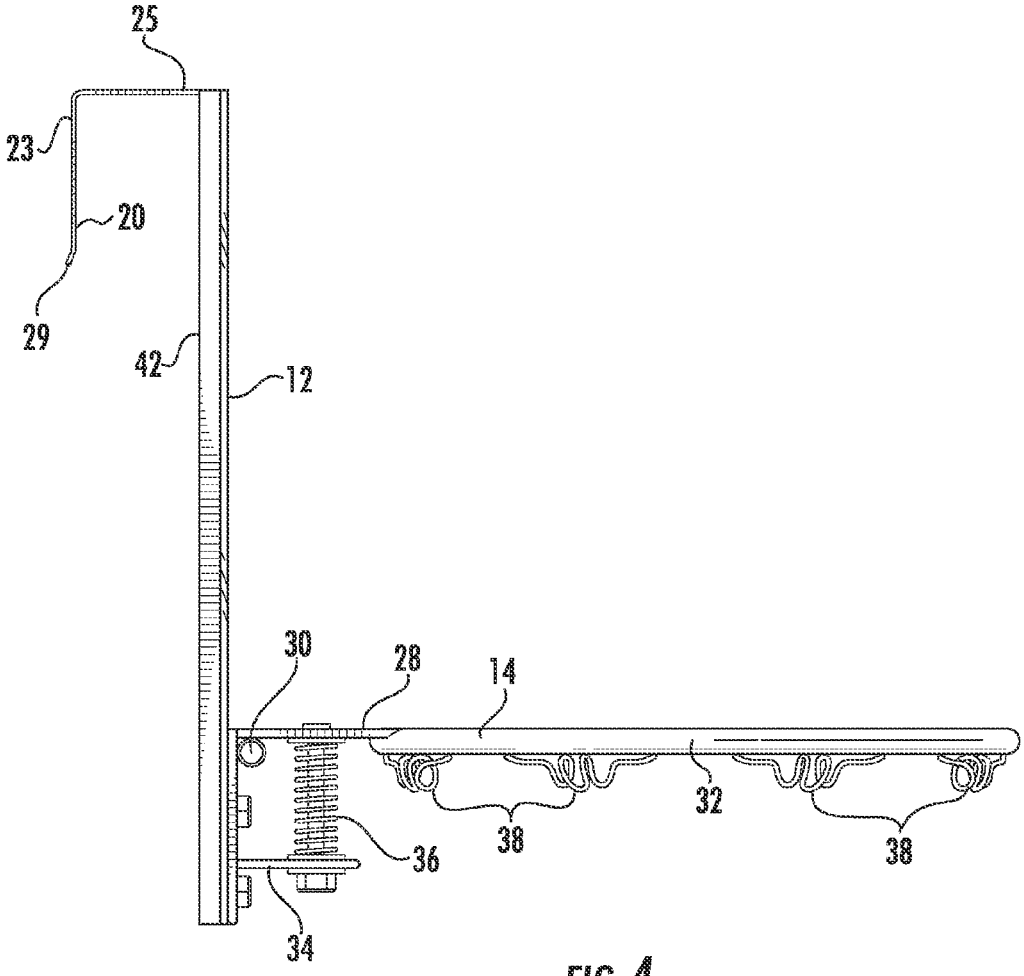
FIG. 4 is a top plan view of the backboard and hoop, with the net removed for clarity.
Figure 5:
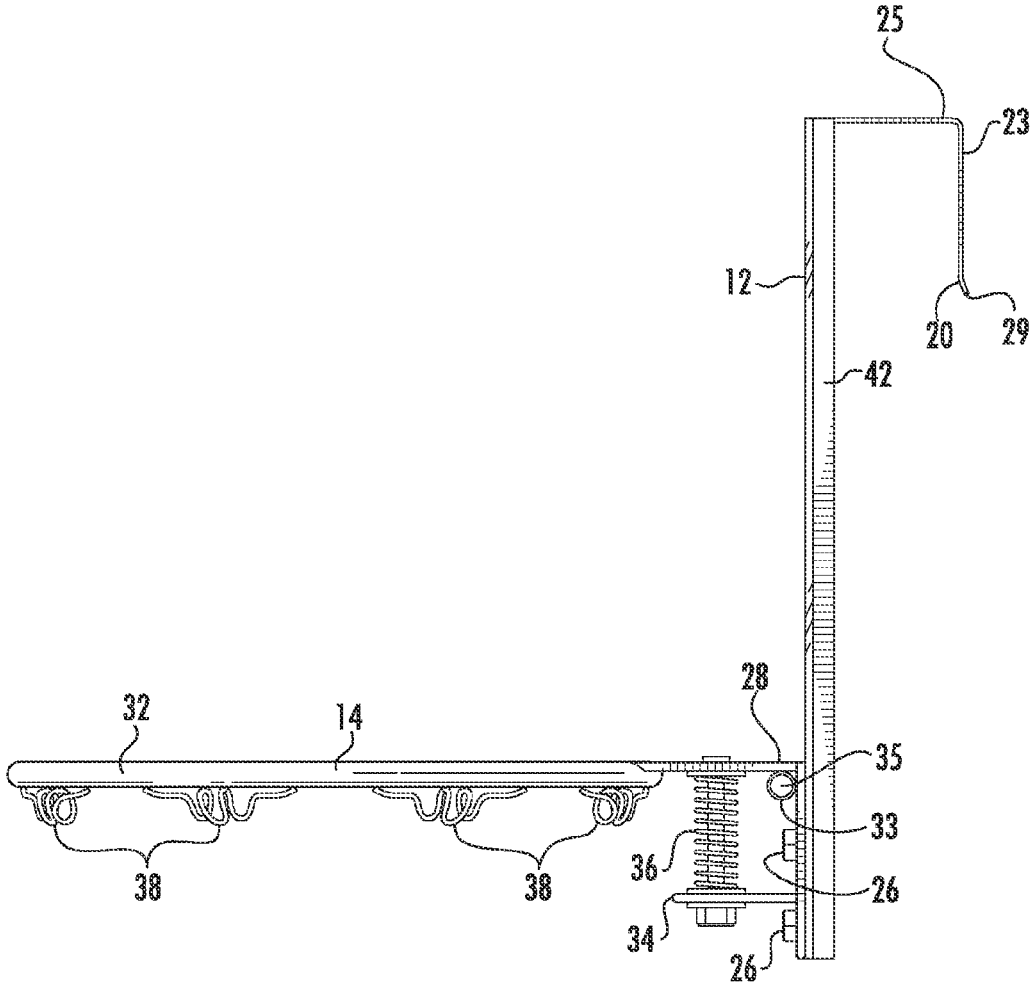
FIG. 5 is a bottom plan view of the backboard and hoop, with the net removed for clarity.
Figure 6:
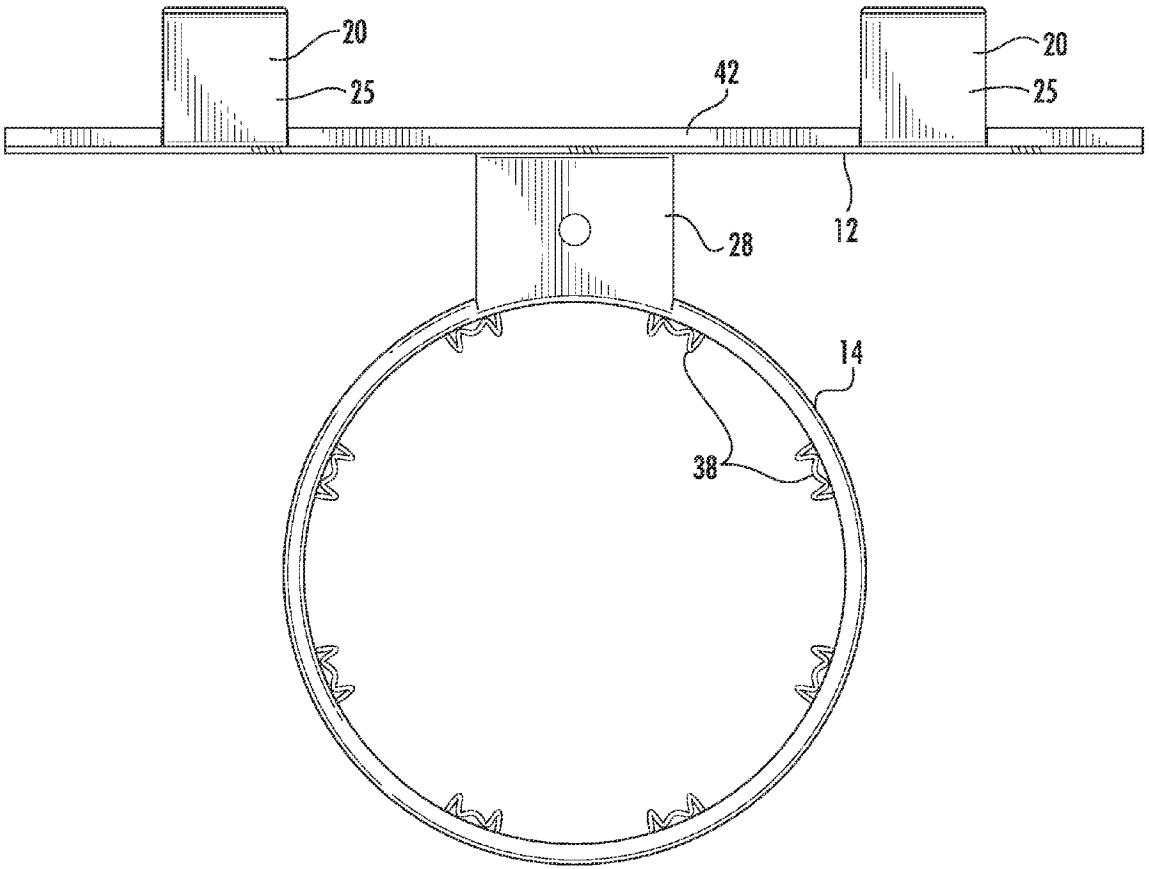
FIG. 6 is a left-side elevation view of the backboard and hoop.
Figure 7:
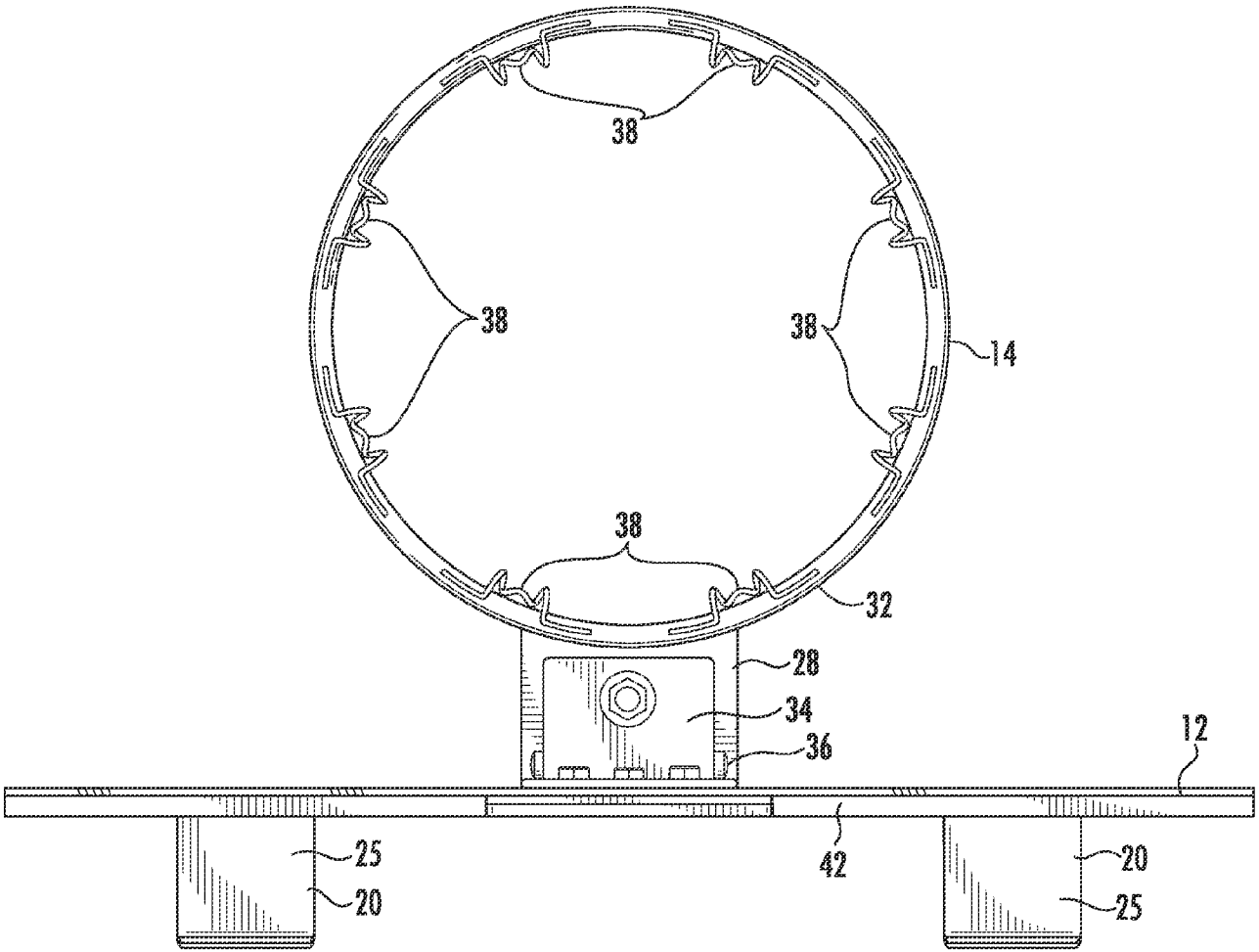
FIG. 7 is a right-side elevation view of the backboard and hoop.
Figure 8:
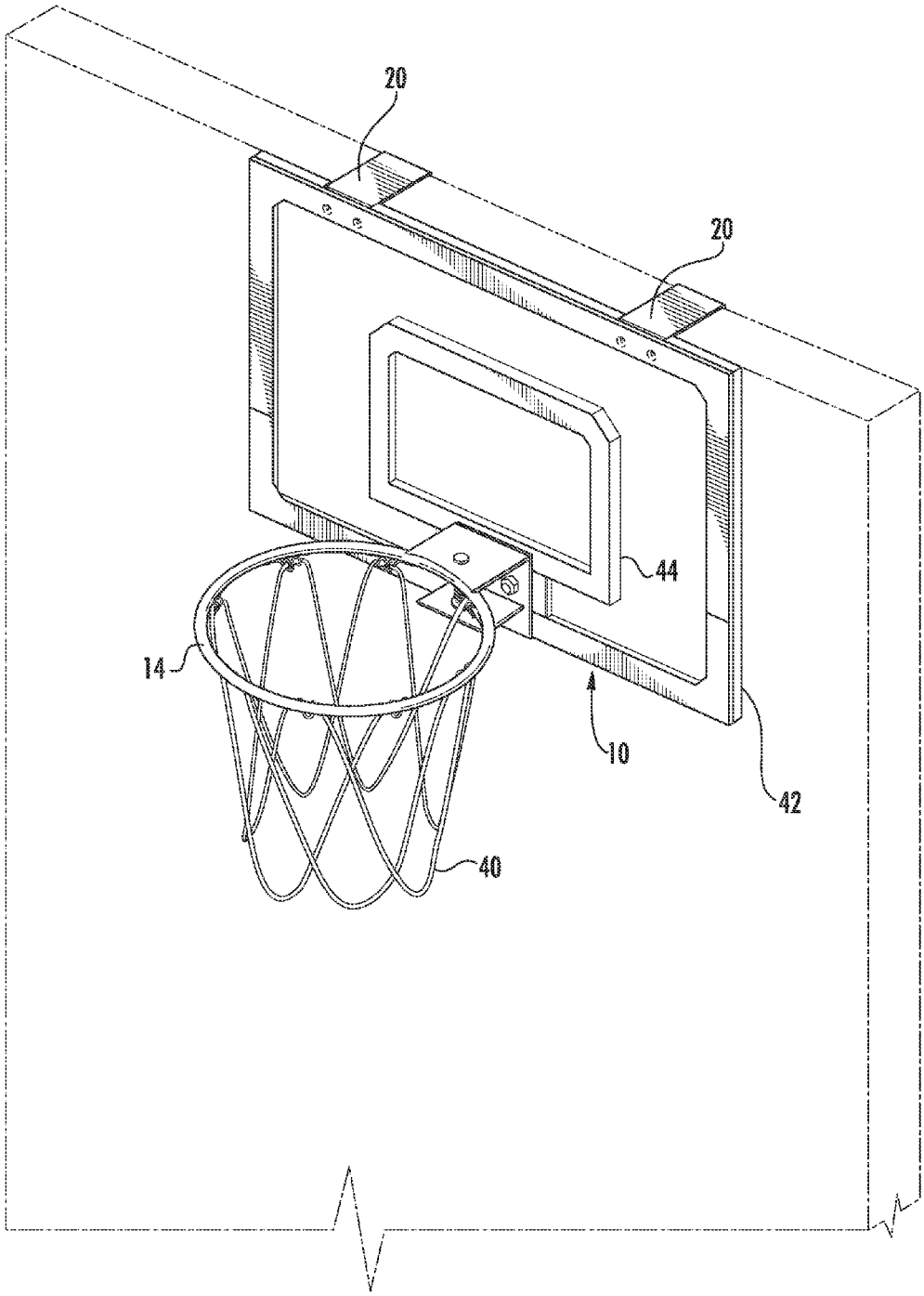
FIG. 8 is a perspective view of the backboard and hoop mounted on a door, with the door shown in broken lines.

At least one sound dampener 42 is provided on the rear face of the backboard 12. Preferably, the sound dampener 42 is in the form of a resilient, soft rubber or foam strip extending around the outer perimeter of the rear face of the backboard 12 so as to engage the door when the hoop 10 is mounted on the door. The sound dampener 42 also protects the door against scratches from the backboard 12. A secondary sound dampener 44 may be provided on the rear face of the backboard 12 immediately behind the target 18. The first and second sound dampeners 42, 44 form substantially concentric inner and outer rings, as seen in FIG. 3. A sound damper 46 is also provided on the back of plate 24. Thus, the sound dampeners 42, 44, 46 are hidden by the perimeter strip 16, the target 18 on the front face of the backboard 12, and the plate 24.

A miniature basketball (not shown) is provided for shooting through the rim 32 and the net 40.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A miniature basketball hoop and backboard, comprising:

a backboard having front and rear surfaces, and top and bottom edges;

at least one hook at the top of the backboard having a front leg, a top leg and a rear leg, with the front leg joined to a front end of the top leg and the rear leg joined to a rear end of the top leg, with front leg perpendicular to the top leg and with the rear leg perpendicular to the top leg and having a lower end flared outwardly away from the rear surface of the backboard, and with the front leg attached to the back surface of the backboard adjacent to the top edge of the backboard;

a front mounting plate attached to the front surface of the backboard, with the front mounting plate having upper and lower ends;

a rim joined to an upper mounting plate;

a hinge on the front mounting plate, with upper mounting plate attached to the hinge;

a lower mounting plate fixed in position on the front mounting plate below the upper mounting plate and between the upper and lower ends of the front mounting plate, with the lower mounting plate substantially parallel to and spaced vertically apart from the upper mounting plate, and with the upper and lower mounting plates substantially perpendicular to the front mounting plate;

a spring secured between the upper and lower mounting plates, with the spring urging the upper mounting plate away from the tower mounting plate, and with the spring in a substantially vertical orientation;

a rear mounting plate on the rear surface of the backboard, with the rear mounting plate separate from the front mounting plate;

a rear mounting plate sound dampener attached to the rear mounting plate;

fasteners extending through the front mounting plate, the backboard, and the rear mounting plate, for attaching the front and rear mounting plates to the backboard; and one or more perimeter sound dampeners on the rear surface of the backboard adjacent to a perimeter of the backboard.

2. The miniature basketball hoop and backboard of claim 1 with the lower mounting plate having a plurality of edges, and with only a rear edge of the lower mounting plate joined to the front mounting plate.

3. The miniature basketball hoop and backboard of claim 1 with the lower end of the front mounting plate extending down to the bottom edge of the backboard.

4. The miniature basketball hoop and backboard of claim 1 further including a bolt extending through the spring and through the upper and lower plates, with the bolt holding the upper and lower plates substantially parallel to each other in a horizontal orientation.

5. The miniature basketball hoop and backboard of claim 1 with the rear mounting plate wider than the front mounting plate.

6. The miniature basketball hoop and backboard of claim 5 with the backboard comprising a transparent material and with left and right sides of the rear mounting plate visible through the backboard.

* * * * *